US005645628A

United States Patent [19]

Endo et al.

[11] Patent Number: 5,645,628

[45] Date of Patent: Jul. 8, 1997

[54] ELECTROLESS PLATING BATH USED FOR FORMING A WIRING OF A SEMICONDUCTOR DEVICE, AND METHOD OF FORMING A WIRING OF A SEMICONDUCTOR DEVICE

[75] Inventors: Masayuki Endo; Akemi Kawaguchi; Mikio Nishio; Shin Hashimoto, all of Osaka, Japan

[73] Assignee: Matsushita Electric Industrial Co., Ltd., Osaka, Japan

[21] Appl. No.: 502,175

[22] Filed: Jul. 13, 1995

[30] Foreign Application Priority Data

Jul. 14, 1994 [JP] Japan ..... 6-162030

[51] Int. Cl.[6] ..... C23C 18/31; C23C 18/40; C23C 18/44

[52] U.S. Cl. ..... 106/1.23; 106/1.24; 106/1.26; 106/1.28

[58] Field of Search ..... 106/1.22, 1.23, 106/1.24, 1.26, 1.28

[56] References Cited

U.S. PATENT DOCUMENTS

| | | | |
|---|---|---|---|
| 4,255,194 | 3/1981 | Hough et al. | 106/1.28 |
| 4,407,869 | 10/1983 | Mallory et al. | 106/1.22 |
| 4,424,241 | 1/1984 | Abys | 427/443.1 |
| 4,482,596 | 11/1984 | Gulla et al. | 106/1.23 |
| 4,684,550 | 8/1987 | Milius et al. | 106/1.23 |
| 5,059,243 | 10/1991 | Jagannathan et al. | 106/1.23 |
| 5,203,911 | 4/1993 | Sricharoenchaikit et al. | 106/1.27 |
| 5,240,497 | 8/1993 | Shacham et al. | 106/1.27 |
| 5,269,838 | 12/1993 | Inoue et al. | 106/1.27 |
| 5,298,058 | 3/1994 | Matsui et al. | 106/1.23 |

FOREIGN PATENT DOCUMENTS

| | | |
|---|---|---|
| 1310995 | 3/1963 | France . |
| 4-307736 | 10/1992 | Japan . |

OTHER PUBLICATIONS

European Search Report.

Metal Finishing Abstracts, vol. 25, No. 4, Jul. 1983, GB p. 201 Mitrofanov electroless cu plating solution of increased stability and giving increased deposition rate.

N. Koura, "Electroless Plating Of Silver", Electroless Plating Fundamentals & Applications, 1985, Chapter 17, pp. 441–462 (no month avail.).

*Primary Examiner*—Helene Klemanski
*Attorney, Agent, or Firm*—McDermott, Will & Emery

[57] ABSTRACT

A contact hole and a wiring groove are formed in an insulating layer formed on a semiconductor substrate. A silver layer is formed inside of the contact hole and the wiring groove and on the insulating layer with the use of an electroless plating bath comprising: silver nitrate containing silver ions; tartaric acid serving as a reducing agent of the silver ions; ethylenediamine serving as a complexing agent of the silver ions; and metallic ions of tetramethylammoniumhydroxide serving as a pH control agent. Then, the silver layer on the insulating layer is removed by a chemical and mechanical polishing method such that an embedded wiring is formed in each of the contact hole and the wiring groove.

2 Claims, 7 Drawing Sheets

ELECTROLESS PLATING BATH USED FOR FORMING A WIRING OF A SEMICONDUCTOR DEVICE, AND METHOD OF FORMING A WIRING OF A SEMICONDUCTOR DEVICE

BACKGROUND OF THE INVENTION

The present invention relates to a novel electroless plating bath to be used for forming a wiring of a semiconductor device, and also to a method of forming a wiring of a semiconductor device with the use of the electroless plating bath above-mentioned.

To deposit a metallic layer which will result in a wiring of a semiconductor device, there has conventionally been used an aluminium sputtering method, a tungsten CVD method, or the like.

However, such a prior art sputtering method or CVD method is disadvantageous in that a sufficient coverage cannot be provided. Also, such a prior art method is disadvantageous in that a large energy is given to the metallic compound to liberate the metal or a large energy is given to separate the metallic compound to be deposited, such that the metal is deposited on the surface of the semiconductor substrate. This not only greatly increases the cost, but also complicates the process.

To achieve the problems above-mentioned, attention has recently been placed on the deposition of a metallic layer using an electroless plating method.

An electroless plating bath having the following composition is proposed by "ELECTROLESS PLATING (1985) Chapter 17 Electroless Plating of Silver N. Koura".

| | |
|---|---|
| Silver nitrate (silver ion source) | $8 \times 10^{-3}$ mol/l |
| Rochelle salt (reducing agent) | $3.5 \times 10^{-2}$ mol/l |
| Ethylenediamine (complexing agent) | $5.4 \times 10^{-2}$ mol/l |
| 3,5-Diiodotyrosine (stabilizer) | $4.0 \times 10^{-5}$ mol/l |
| NaOH or KOH (pH control agent) | |
| pH | 10.0 |
| Bath temperature | 35° C. |

However, when the inventors of the present invention formed a metallic wiring layer of a semiconductor device, using the electroless plating bath above-mentioned, they found that the semiconductor device was deteriorated in characteristics.

After hard study, they found that the electroless plating bath contained metallic impurities (alkali metal, alkali earth metal and the like) such as Na, K and the like, and that after contained in the plated layer serving as wiring metal, such metallic impurities diffused in the semiconductor device to deteriorate the characteristics thereof.

The inventors of the present invention found that the amounts of Na and K in the electroless plating bath above-mentioned as measured by atomic emission spectroscopy (ICP) were as high as 7411 ppm and 6993 ppm, respectively. Further, Na and K are contained even in the deposited silver plated layer. The inventors also found that the amounts of Na and K in the silver layer having a thickness of 0.5 μm deposited on the semiconductor substrate, were 842 ppm and 411 ppm, respectively. These values are much higher than the allowance for the metallic impurities contained in the wiring metal of a semiconductor device.

SUMMARY OF THE INVENTION

In view of the foregoing, the present invention is proposed with the object of forming, using an electroless plating bath, a metallic wiring layer of a semiconductor device substantially containing no metallic impurities.

The present invention is proposed based on the finding that the inclusion of metallic impurities in a metallic wiring layer resulted from metals contained in the pH control agent and the reducing agent of the metallic ions in the electroless plating bath. Therefore, according to the present invention, there is used an electroless plating bath containing a pH control agent and a reducing agent of metallic ions, each of these agents containing no metal in the chemical formula thereof.

The present invention provides an electroless plating bath to be used for forming a wiring of a semiconductor device, comprising: a metallic material containing metallic ions; a reducing agent of the metallic ions which contains no metal in the chemical formula thereof; a complexing agent of the metallic ions which contains no metal in the chemical formula thereof; and a pH control agent which contains no metal in the chemical formula thereof.

In the electroless plating bath, each of the reducing agent, the complexing agent and the pH control agent contains no metal in the chemical formula thereof. Accordingly, metallic impurities are hardly contained in the electroless plating bath. This lowers, to not greater than the allowable level, the amount of metallic impurities in a metallic layer formed with the use of the electroless plating bath. Thus, with the use of the electroless plating bath, a metallic layer can be formed without the semiconductor device lowered in characteristics.

The present invention also provides a method of forming a wiring of a semiconductor device, comprising: the first step of forming a concave at a contact zone or a wiring zone of a resist pattern or an insulating layer formed on the semiconductor substrate; and the second step of forming an embedded metallic layer in the concave with the use of an electroless plating bath comprising: a metallic material containing metallic ions; a reducing agent of the metallic ions which contains no metal in the chemical formula thereof; a complexing agent of the metallic ions which contains no metal in the chemical formula thereof; and a pH control agent which contains no metal in the chemical formula thereof.

According to the method above-mentioned, metallic impurities are hardly contained in the electroless plating bath. Thus, with the use of the electroless plating bath, a metallic layer can be formed without the semiconductor device lowered in characteristics.

Preferably, the method of forming a wiring of a semiconductor device above-mentioned further comprises, between the first and second steps, the intermediate layer forming step of successively forming, on the bottom of the concave, a resistance reducing layer for reducing the contact resistance of the embedded metallic layer, a barrier layer for preventing the embedded metallic layer from reacting, and a catalyzer layer for promoting the reaction of the metallic ions.

With such an arrangement, the resistance reducing layer is formed on the bottom of the concave, thereby to reduce the contact resistance between the embedded metallic layer and the semiconductor substrate. Further, the barrier layer is formed on the resistance reducing layer. This prevents the metal forming the embedded metallic layer from dispersing into an element such as a transistor or the like formed on the semiconductor substrate. Further, the catalyzer layer is formed on the barrier layer. Accordingly, even though the embedded metallic layer and the layer thereunder are different in material from each other, the embedded metallic layer can successfully be deposited.

The catalyzer layer and the barrier layer may be the same layer. In such a case, since the catalyzer layer also serves as the barrier layer, the production process can be shortened. When the catalyzer layer and the barrier layer are formed by the same layer, there may be used a palladium layer, a TiN layer containing palladium, a TiN layer, a W layer or a mixture layer of these metals. However, a layer of other substance may also be used.

Preferably, (i) the intermediate layer forming step comprises: the step of successively forming, inside of the concave and on the resist pattern or the insulating layer, a resistance reducing layer, a barrier layer and a catalyzer layer; and the step of removing, by a chemical and mechanical polishing method, the resistance reducing layer, the barrier layer and the catalyzer layer on the resist pattern or the insulating layer such that the resistance reducing layer, the barrier layer and the catalyzer layer are formed only on the bottom of the concave, and (ii) the second step comprises the step of selectively forming an embedded metallic layer on the catalyzer layer formed only on the bottom of the concave.

With such an arrangement, the embedded metallic layer can selectively be formed only on the bottom of the concave. This eliminates the step of removing the metallic layer on the insulating layer or the resist pattern, enabling the embedded metallic layer to be efficiently formed. In this case, each of the resistance reducing layer, the barrier layer and the catalyzer layer is made of metal, but removed by a chemical and mechanical polishing method. Thus, these layers can readily and securely be removed.

Preferably, the catalyzer layer is a Pd layer or a Ti layer. Since the Pd layer or Ti layer is generally formed by vapor deposition or sputtering and is therefore made fine or compact, a plated layer deposited thereon is also made fine or compact. The Pd layer or Ti layer is preferable because, at the time of heating treatment after a plated layer has been formed, such a Pd or Ti layer not only prevents a void from being formed in the plated layer, but also prevents the adhesion with the semiconductor substrate from becoming defective.

Preferably, the barrier layer is a TiN layer, a TiW layer or a W layer.

Preferably, the resistance reducing layer is a Ti layer.

In the method of forming a wiring of a semiconductor device above-mentioned, the second step preferably comprises: the step of forming, with the use of the electroless plating bath, a metallic layer inside of the concave and on the resist pattern or the insulating layer in its entirety; and the step of removing the metallic layer on the resist pattern or the insulating layer such that the embedded metallic layer is formed inside of the concave. With such an arrangement, the embedded metallic layer can securely be formed in the concave.

In the method of forming a wiring of a semiconductor device above-mentioned, the second step preferably comprises: the step of forming, with the use of the electroless plating bath, a metallic layer inside of the concave and on the insulating layer in its entirety; and the step of removing, by a chemical and mechanical polishing method, the metallic layer on the insulating layer such that the embedded metallic layer is formed inside of the concave with the surface of the embedded metallic layer being flush with the surface of the insulating layer.

The chemical and mechanical polishing method can remove a metallic layer which cannot be removed by etching. Thus, the metallic layer can readily and securely be removed.

In the method of forming a wiring of a semiconductor device above-mentioned, the method preferably further comprises, before the first step, the lower insulating layer forming step of forming, on the semiconductor substrate, a lower insulating layer having an embedded plug, and the first step preferably comprises: the step of forming the insulating layer on the lower insulating layer; the step of forming, on the insulating layer, a wiring zone forming resist pattern having an opening at the position thereof corresponding to the embedded plug; and the step of etching the insulating layer with the wiring zone forming resist pattern serving as a mask, thereby to form, in the insulating layer, the concave which will result in a wiring zone.

When the insulating layer is etched with the wiring zone forming resist pattern serving as a mask, a wiring concave can be formed at the position corresponding to the embedded plug. When an embedded metallic layer is formed in the concave, there can securely be formed an embedded wiring layer which is connected to the embedded plug.

In the method of forming a wiring of a semiconductor device above-mentioned, the method preferably further comprises, before the first step, the lower insulating layer forming step of forming, on the semiconductor substrate, a lower insulating layer having an embedded plug, and the first step preferably comprises the step of forming, on the lower insulating layer, a resist pattern having, at the position thereof corresponding to the embedded plug, an opening which will result in a concave.

With such an arrangement, there can securely be formed an embedded wiring layer which is connected to the embedded plug.

Preferably, the metallic ions contained in the metallic material are silver ions, copper ions, gold ions, nickel ions, cobalt ions or palladium ions.

By electroless plating, these metallic ions separate out successfully as metal, which can be used for forming a metallic wiring or plug of a semiconductor device. In particular, silver, copper and gold are suitable for wiring metal, because these metals are low in specific resistance as compared with aluminium conventionally used for wiring metal.

There may be supplied silver ions from silver nitrate, copper ions from cupric sulfate, gold ions from gold ammonium cyanide or gold chloride, nickel ions from nickel sulfate or nickel chloride, cobalt ions from cobalt sulfate or cobalt chloride, and palladium ions from palladium sulfate or palladium chloride. However, examples of the metallic materials are not limited to those above-mentioned.

The metallic ions contained in the metallic material are preferably silver ions, copper ions, gold ions or palladium ions, and the reducing agent preferably comprises at least one substance selected from the group consisting of tartaric acid, tartrate containing no metal in the chemical formula thereof, monosaccharide, disaccharide, polysaccharide, hydrazine, a hydrazine derivative, aldehyde and polyol.

These metallic ions are particularly suitable because their oxidation-reduction potentials are high such that the metallic ions are liable to separate out in the plating bath. Accordingly, a metallic layer can successfully be formed. The examples above-mentioned of the reducing agent are high in oxidation-reduction potential and contain no metal in the chemical formulas thereof. Accordingly, they properly restrain the separation of the metallic ions. Thus, these examples can suitably be used as the reducing agent.

As the tartrate containing no metal in the chemical formula thereof, ammonium tartrate may be mentioned.

Examples of monosaccharide include, among others, glucose, dextrose, glucolactone, glucopyranose, fructose and any of mixtures of the substances above-mentioned. Examples of disaccharide include, among others, saccharose, lactose, maltose and any of mixtures of the substances above-mentioned. Examples of polysaccharide include, among others, alginic acid, cellulose, starch, glycogen, pullulan and any of mixtures of the substances above-mentioned. Examples of the hydrazine derivative include, among others, hydrazine sulfate, hydrazine hydrochloride, hydrazine hydrate and any of mixtures of the substances above-mentioned. Examples of aldehyde include, among others, formalin, glyoxal and any of mixtures of these substances. Examples of polyol include, among others, glycerol. However, examples of the reducing agent containing no metal in the chemical formula, are not limited to the substances above-mentioned.

The metallic ions contained in the metallic material are preferably nickel ions or cobalt ions, and the reducing agent preferably comprises at least one substance selected from the group consisting of hypophosphorous acid, hypophosphite containing no metal in the chemical formula thereof, a boron hydroxide compound containing no metal in the chemical formula thereof, hydrazine and a hydrazine derivative.

These metallic ions are lower in oxidation-reduction potential than silver ions, copper ions, gold ions, palladium ions and the like, but the examples above-mentioned of the reducing agent are also relatively low in oxidation-reduction potential. Accordingly, a plated layer made of any of these metallic ions can efficiently be deposited. Further, none of these examples of the reducing agent contains metal in the chemical formula.

Examples of hypophosphite containing no metal in the chemical formula thereof include, among others, ammonium hypophosphite. Examples of boron hydroxide compound containing no metal in the chemical formula include, among others, borane, borazane, borazene, borazine, a borane derivative, a borazane derivative, a borazene derivative, a borazine derivative and any of mixtures of these substances. Examples of the borane derivative include, among others, diborane, methyldi-borane and any of mixtures of these substances. Examples of the borazane derivative include, among others, diborazane, diethylamine borazane, dimethylamine borazane, trimethylamine borazane and any of mixtures of these substances.

The metallic ions contained in the metallic material are preferably silver ions or copper ions, and the complexing agent preferably comprises at least one substance selected from the group consisting of ethylenediamine, an ethylenediamine derivative, ammonia and triethanolamine.

Each of these complexing agents forms a complex of silver ions or copper ions at the alkali side, and promotes the deposition of metal in an alkaline plating bath.

Examples of the ethylenediamine derivative include, among others, N,N-bis(2-hydroxyethyl)ethylenediamine, N,N'-bis(2-hydroxyethyl)ethylenediamine ethylenediamine, N,N,N',N'-tetraxis(2-hydroxyethyl)ethylenediamine, ethylenediaminetetraacetic acid and any of mixtures of the substances above-mentioned.

The metallic ions contained in the metallic material are preferably gold ions, nickel ions, cobalt ions or palladium ions, and the complexing agent is preferably a compound containing a carboxylic acid group.

The compound containing a carboxylic acid group is preferable because it forms a complex together with gold ions, nickel ions, cobalt ions or palladium ions.

Examples of the compound containing a carboxylic acid group include, among others, citric acid, acetic acid, lactic acid, ortho-hydroxybenzoic acid, oxalic acid, malonic acid, succinic acid, malic acid, tartaric acid, ortho-phthalic acid, diglycolic acid, thioglycolic acid, thiodiglycolic acid, glycine, methylglycine, dimethylglycine, anthranilic acid, picolinic acid, quinolinic acid and any of mixtures of these substances.

The pH control agent preferably comprises at least one substance selected from the group consisting of ammonium salt, ammonia, nitric acid and boric acid.

Such a pH control agent is preferable in that it works equally to or more than conventionally used KOH or NaOH, and that it is water-soluble and contains no metal in the chemical formula. Further, since each of nitric acid and boric acid acts to lower the pH value, it is suitable for obtaining an electroless plating bath of which pH is low.

Examples of ammonium salt include, among others, tetramethylammoniumhydroxide, trimethylammoniumhydro-oxide, choline, ammonium carbonate and any of mixtures of these substances.

The metallic material is preferably silver nitrate, the reducing agent is preferably tartaric acid, the complexing agent is preferably ethylenediamine, and the pH control agent is preferably tetramethylammonium-hydroxide.

The electroless plating bath comprising silver nitrate, tartaric acid, ethylenediamine and tetramethyl-ammonium-hydroxide, is the best as an electroless plating bath for forming, on a semiconductor substrate, a metallic layer made of a silver plated layer. More specifically, such a bath contains no metallic impurities and such a bath is particularly good in view of (i) the quality of a silver plated layer to be formed, (ii) the adhesion of the silver plated layer to the semiconductor substrate and (iii) the embedding characteristics of the silver plated layer with respect to a contact hole or a wiring groove in the semiconductor substrate. Further, ethylene-diamine is preferable because of its easiness in handling, and tetramethylammoniumhydroxide is preferable because of its reduced smell and its difficulty of evaporation.

Preferably, the metallic material contains two or more types of metallic ions. In this case, there can be formed a plated layer of an alloy comprising two or more metals. Such a plated layer of an alloy is preferable because of its improvement in hardness as compared with a metallic layer made of single metal.

Combinations of metallic ions include, among others, nickel ions with cobalt ions, nickel ions with tungsten ions, cobalt ions with tungsten ions and the like. Tungsten ions may be supplied from ammonium tungstate for example.

Preferably, the electroless plating bath further comprises at least one substance selected from the group consisting of: a pH buffer for restraining the plating solution from being lowered in pH, the buffer containing no metal in the chemical formula thereof; a promotor for restraining the plating speed from being lowered, the promotor containing no metal in the chemical formula thereof; a stabilizer for preventing the plating solution from being decomposed, the stabilizer containing no metal in the chemical formula thereof; and a surfactant for making the resulting plated layer fine in quality, the surfactant containing no metal in the chemical formula thereof.

Examples of the pH buffer include, among others, monocarboxylic acid, dicarboxylic acid, oxycarboxylic acid, inorganic acid and any of mixtures of the substances above-mentioned. Examples of the promotor include, among others, dicarboxylic acid, oxycarboxylic acid and any of mixtures of these substances.

Examples of monocarboxylic acid include, among others, formic acid, acetic acid, propionic acid, butyric acid, n-pentanoic acid, acrylic acid, trimethylacetic acid, benzoic acid, chloracetic acid and any of mixtures of these substances.

Examples of dicarboxylic acid include, among others, oxalic acid, succinic acid, malonic acid, maleic acid, itaconic acid, paraphthalic acid and any of mixtures of these substances.

Examples of oxycarboxylic acid include, among others, glycolic acid, lactic acid, salicylic acid, tartaric acid, citric acid and any of mixtures of these substances.

Examples of inorganic acid include, among others, boric acid. carbonic acid, sulfurous acid and any of mixtures of these substances.

Examples of the stabilizer include, among others, a sulfur compound, a nitrogen compound, an iodide and any of compounds of the compounds above-mentioned.

Examples of the sulfur compound include, among others, thiourea, thiosulfate, diethyldithiocarbamate, rhodanine and any of mixtures of these substances. Examples of the nitrogen compound include, among others, 2,2'-dipyridyl, orthophenanthroline, 2,2'-biquinoline and any of mixtures of these substances. Examples of the iodide include, among others, 3-iodotyrosine, 3,5-di-iodotyrosine and any of mixtures of these substances.

Examples of the surfactant include, among others, a nonionic fluorine-contained surfactant.

DETAILED DESCRIPTION OF THE PREFERRED EMBODIMENTS (First Embodiment)

The following description will discuss the electroless plating bath according to a first embodiment of the present invention.

There was prepared an electroless silver plating bath having the following composition. The amounts of Na and K in this electroless silver plating bath as measured by atomic emission spectroscopy (ICP), were as small as 2 ppm and 3 ppm, respectively. It is considered that such impurities in small amounts were mixed in production steps of the respective components.

*Electroless Silver Plating Bath According to the First Embodiment of the Present Invention:

| | |
|---|---|
| Silver nitrate (silver ion source) | $8.8 \times 10^{-3}$ mol/l |
| Tartaric acid (reducing agent) | $5.3 \times 10^{-2}$ mol/l |
| Ethylenediamine (complexing agent) | $5.4 \times 10^{-2}$ mol/l |
| 15-wt % Solution of tetramethylammonium-hydroxide (pH control agent) | |
| 3,5-Diiodotyrosine (stabilizer) | $8.0 \times 10^{-5}$ mol/l |
| pH | 10.0 |
| Bath temperature | 35° C. |

Using the plating bath of the first embodiment, a silver plated layer having a thickness of 0.5 μm was deposited on the semiconductor substrate. The amounts of Na and K in this silver plated layer were measured as 0.2 ppm and 0.2 ppm, respectively. These values are much lower than the allowable level for metallic impurities contained in a wiring metal of a semiconductor device. Thus, it was made sure that the silver layer deposited with the use of this plating bath can be used for a metallic wiring of a semiconductor device.

Figure 1:
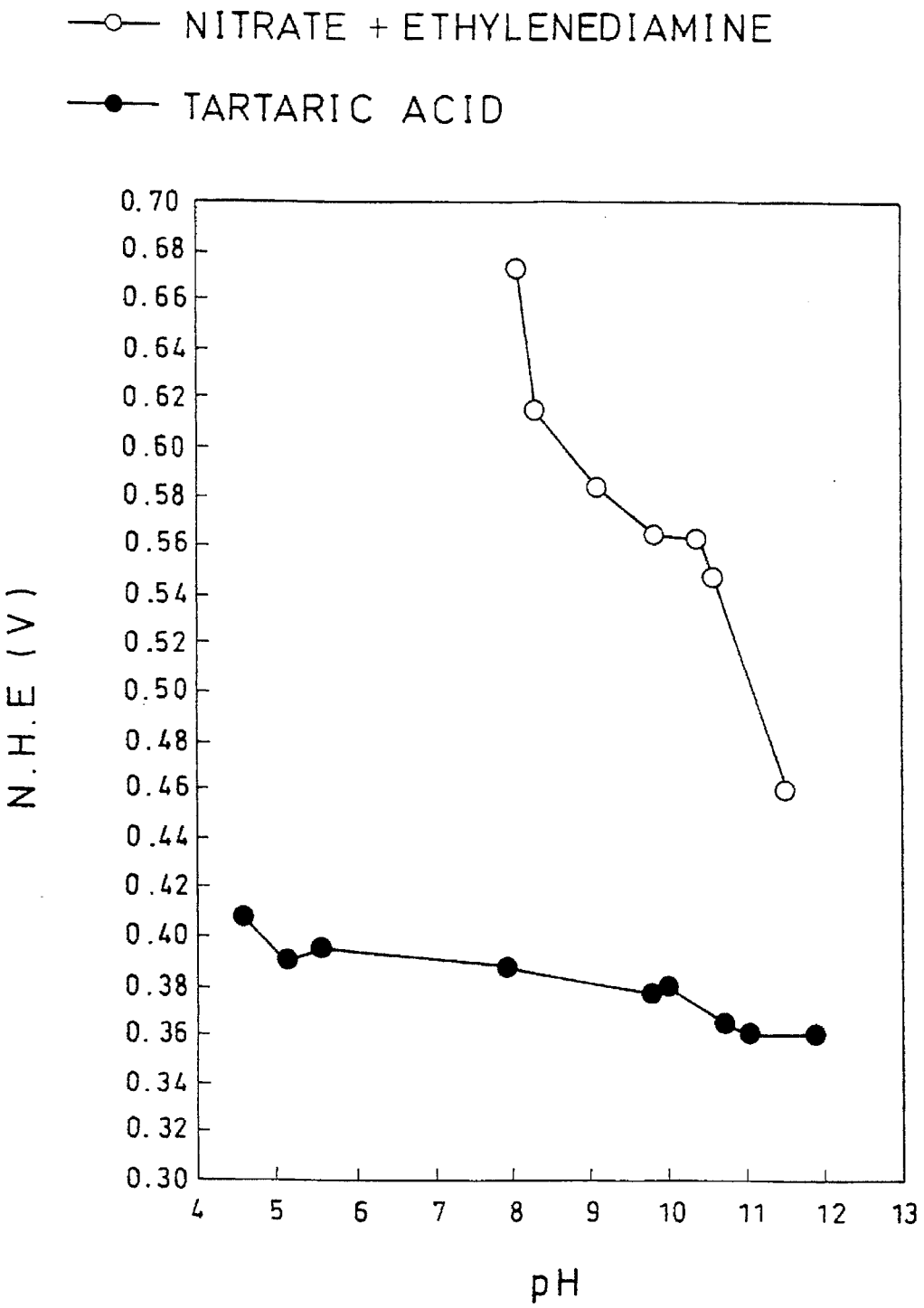
FIG. 1 is a view illustrating the oxidation-reduction potentials (N, H, E) of silver nitrate+ethylenedi-amine, and tartaric acid in the electroless plating bath according to a first embodiment of the present invention.

FIG. 1 shows the results of measured oxidation-reduction potentials (N, H, E) of silver nitrate+ethylenediamine, and tartaric acid in the plating bath according to the first embodiment. As shown in FIG. 1, the potential difference in the vicinity of pH 9.8 at which a silver layer is deposited, is about 0.18 V. It is therefore made sure that the combination of the reducing agent with the complexing agent, the respective concentrations of the reducing agent and the complexing agent, and the pH value in the first embodiment, are suitable for depositing a silver layer on the substrate at suitable speed with no silver separating out in the plating solution. Further, the solution of tetramethylammonium-hydroxide caused no trouble in adjusting the pH to about 9.8. The 3,5-diiodotyrosine serving as the stabilizer produced the effect that the plating bath underwent no substantial change in pH value even after the passage of about 8 hours after the start of plating, and that the plating bath was not decomposed at all due to the separation of silver oxide.

(First Wiring Forming Method)

Figure 2A:
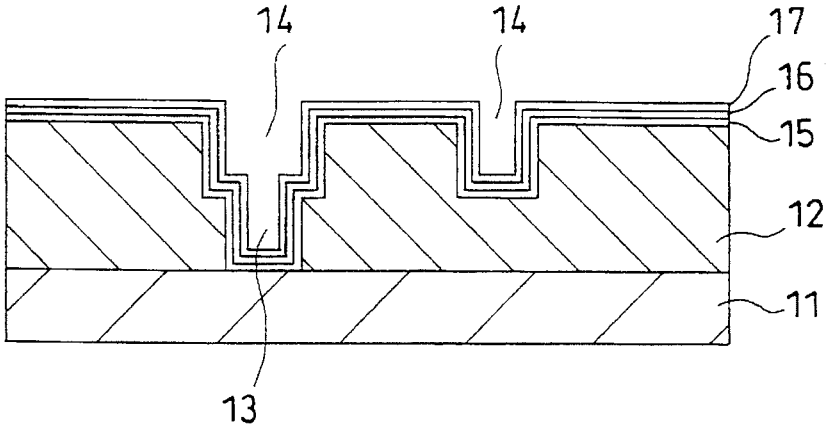
FIGS. 2(*a*), 2(*b*) and 2(*c*) are section views of the steps of a first method of forming a wiring of a semiconductor device, using the electroless plating bath according to the first embodiment of the present invention.
Figure 2B:
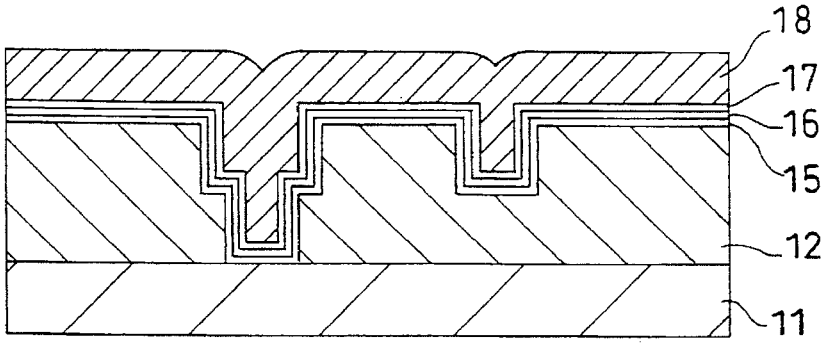
Figure 2C:
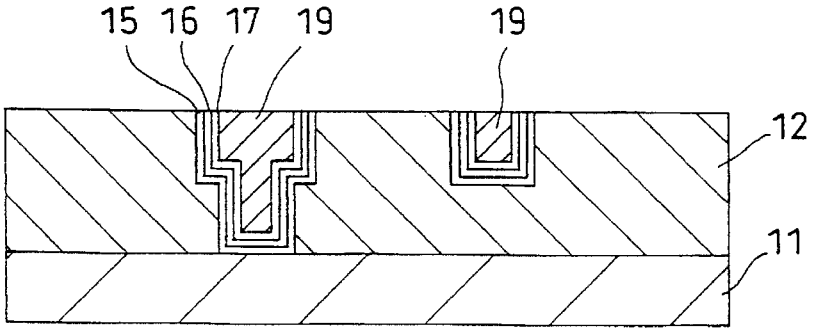

With reference to FIGS. 2(*a*), 2(*b*) and 2(*c*), the following description will discuss a first method of forming a wiring of a semiconductor device, using the plating bath according to the first embodiment.

As shown in FIG. 2(*a*), an insulating layer 12 having a thickness of 0.7 μm was deposited on a semiconductor substrate 11 having a semiconductor element (not shown) thereon. By a lithography and etching technique, there were formed a contact hole (zone which is connected to the semiconductor element) 13 and wiring grooves 14. By a sputtering method, there were deposited a Ti layer 15 (25 nm) as a resistance reducing layer for reducing the resistance between the semiconductor substrate and a silver layer to be formed later, a TiN layer 16 (100 nm) as a barrier layer, and a palladium layer 17 (100 nm) as a catalyzer layer for silver plating.

After the semiconductor substrate 11 had been immersed for 5 hours in the plating bath according to the first embodiment, the semiconductor substrate 11 was washed with water to form a silver layer 18 as shown in FIG. 2(*b*). The thickness of the silver layer 18 formed by the plating bath, was about 0.22 μm.

Figure 3:
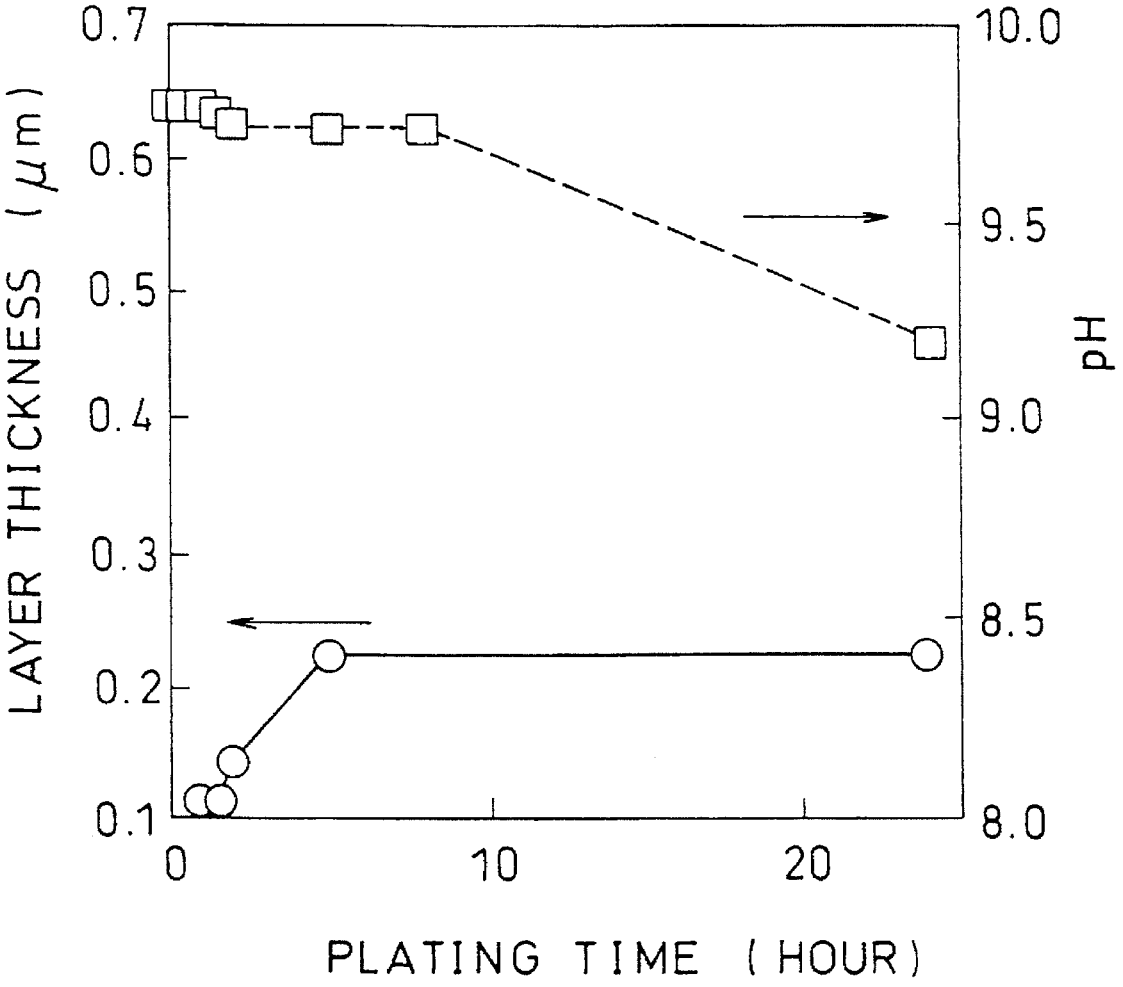
FIG. 3 is a view illustrating the relationship between plating time, silver layer thickness and pH of the plating bath when plating is conducted using the electroless plating bath according to the first embodiment of the present invention.

FIG. 3 shows the relationship between plating time, silver layer thickness and plating bath pH when plating was conducted with the use of the plating bath of the first embodiment. As apparent from FIG. 3, the pH shows no substantial change during about 8 hours after the start of plating (reduction of 0.06), and the thickness of the silver layer is saturated to 0.22 μm (5 hours).

Then, a plating bath having the same composition as above-mentioned was newly prepared, and the immersion of the semiconductor substrate 11 in the plating bath for 2 hours, was further repeated four times such that silver was embedded in the contact hole 13 and the wiring grooves 14 in their entirety. Thus, the insulating layer 12 was covered with the silver layer 18 as shown in FIG. 2(*b*).

Then, by chemical mechanical polishing (CMP), the silver layer 18, the palladium layer 17, the TiN layer 16 and the Ti layer 15 on the insulating layer 12 were removed such that the surface of the insulating layer 12 was substantially flush with the surface of the silver layer 18 embedded in the contact hole 13 and the wiring grooves 14. Thus, embedded wirings 19 made of the silver layer were formed as shown in FIG. 2(*c*).

Since the embedded wirings 19 contained metallic impurities such as Na, K and the like only in an amount of not greater than the allowable level, no adverse effect was exerted to the characteristics of the semiconductor element. Further, it is noted that both the plating bath of the first embodiment and the characteristics of the palladium layer 17 as the catalyzer layer, provide the embedded wirings 19 with the following three advantages. Firstly, the embedded wirings 19 are improved in finesse or compactness, the adhesion with the semiconductor substrate 11 and embedding characteristics with respect to the contact hole 13 and the wiring grooves 14. Secondly, the embedded wirings 19 are lowered in contact resistance. Thirdly, even though in order to restore damages caused by the etching conducted on the semiconductor element before the plating process, the semiconductor substrate 11 was annealed at 400° to 500° C. after the plating process, no void was formed in the embedded wirings 19 and the adhesion between the embedded wirings 19 and the semiconductor substrate 11 did not become defective.

Such annealing on the semiconductor substrate 11 may be conducted before the silver layer 18 and the like are subjected to chemical mechanical polishing.

Further, before the plating process, the palladium layer 17 may be washed with water with the surface thereof immersed in a BHF (hydrofluoric acid:ammonium fluoride= 1:20) solution such that the surface of the palladium layer 17 is cleaned.

The concentrations of the components, the pH, the temperature and the like of the plating bath according to the first embodiment, are not limited to those mentioned earlier, but may be set such that silver does not separate out in the plating bath, and that the plating bath is stable from the start of plating to the completion of deposition of a silver layer on the semiconductor substrate. After hard study of the inventors of the present invention, it was found that, with respect to the molarity of silver nitrate, the molarity of tartaric acid and ethylenediamine was preferably about 3 times to about 10 times and the molarity of 3,5-diiodotyrosine was preferably 1/300 to 1/30, that the pH was preferably from about 9 to about 12, and that the temperature was preferably from about 20° C. to about 50° C. According to the present invention, however, such conditions are not limited to those above-mentioned.

According to the first wiring forming method, tungsten or the like may be embedded by CVD only in the contact hole 13 while the silver layer 18 may be embedded only in the wiring grooves 14.

(Second Wiring Forming Method)

Figure 4A:
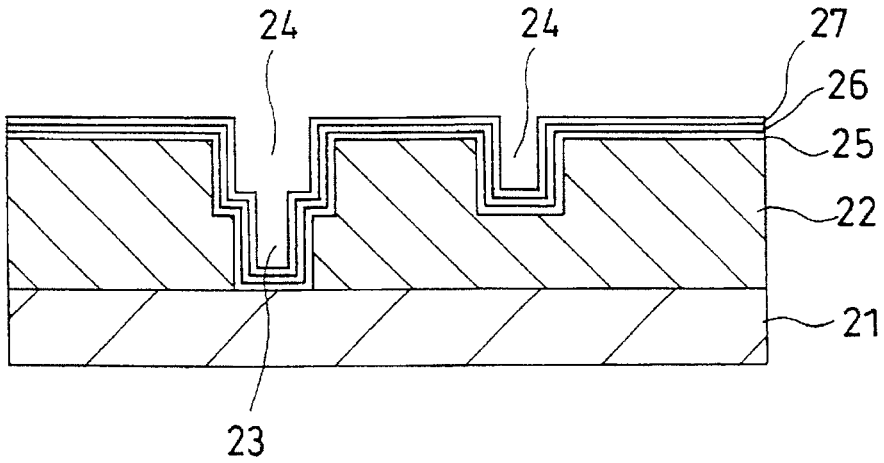
FIGS. 4(*a*), 4(*b*) and 4(*c*) are section views of the steps of a second method of forming a wiring of a semiconductor device, using the electroless plating bath according to the first embodiment of the present invention.
Figure 4B:
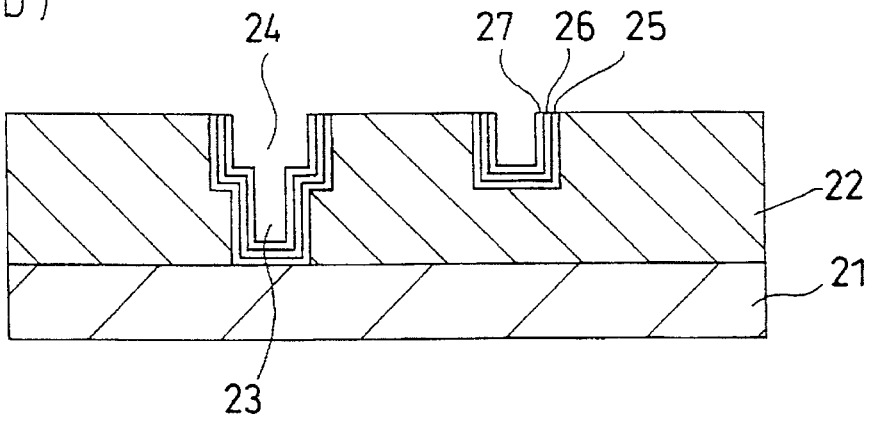
Figure 4C:
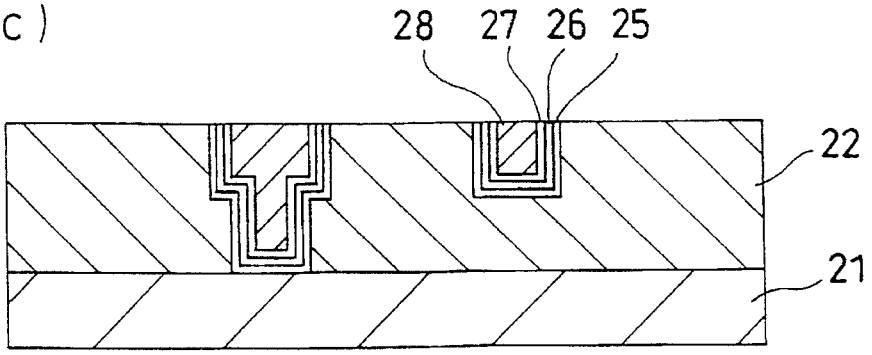
Figure 5A:
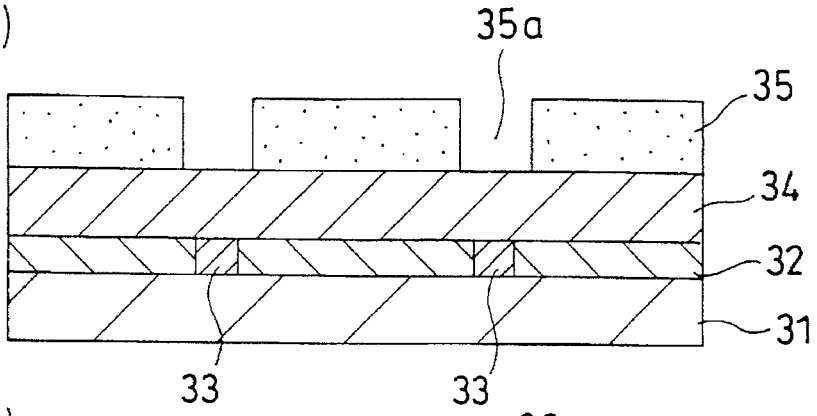
FIGS. 5(*a*), 5(*b*), 5(*c*), 5(*d*) and 5(*e*) are section views of the steps of a third method of forming a wiring of a semiconductor device, using the electroless plating bath according to the first embodiment of the present invention.
Figure 5B:
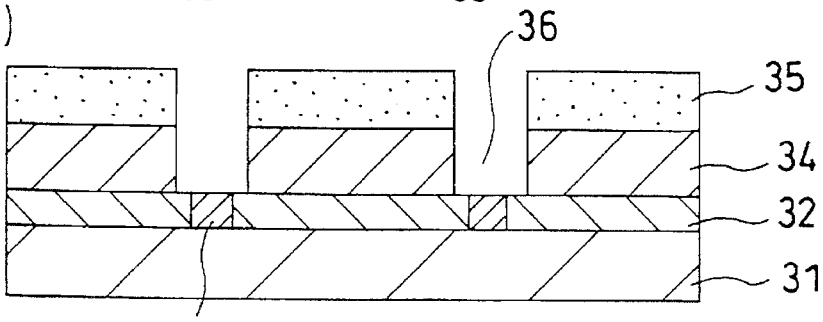
Figure 5C:
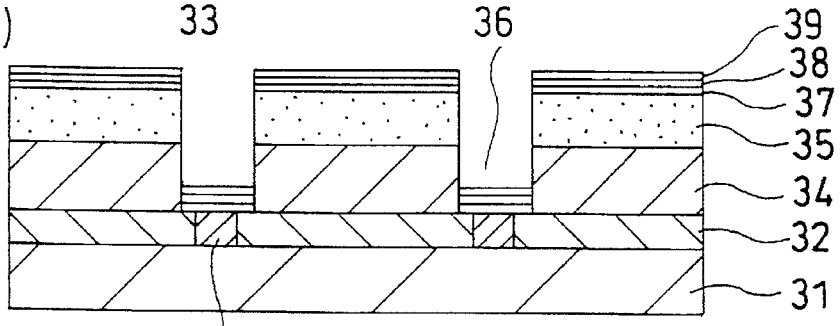
Figure 5D:
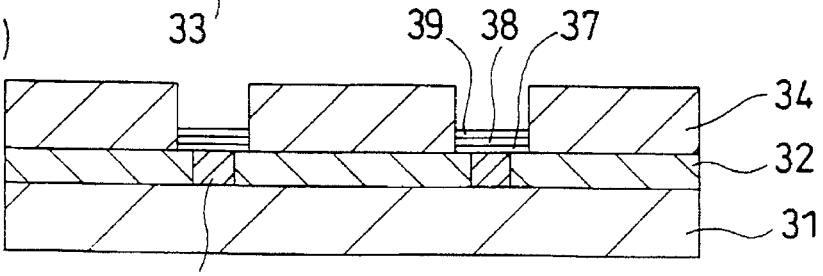
Figure 5E:
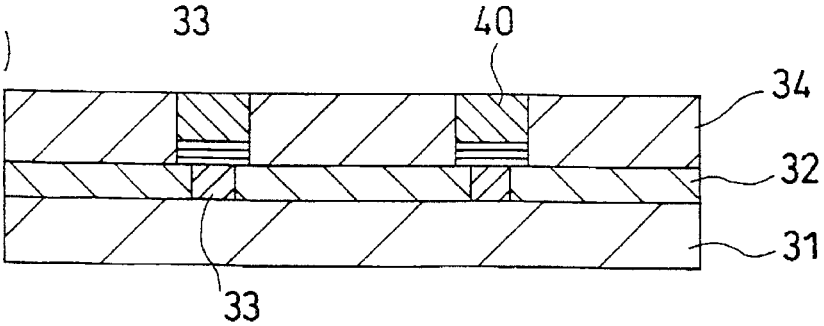
Figure 6A:
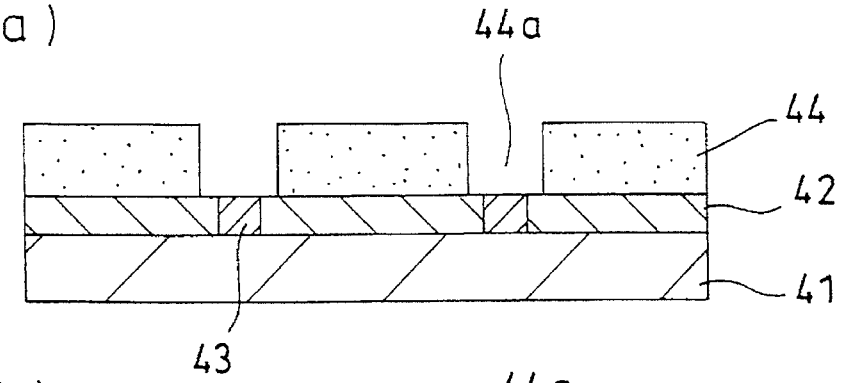
FIGS. 6(*a*) 6(*b*), 6(*c*) and 6(*d*) are section views of the steps of a fourth method of forming a wiring of a semiconductor device, using the electroless plating bath according to the first embodiment of the present invention.
Figure 6B:
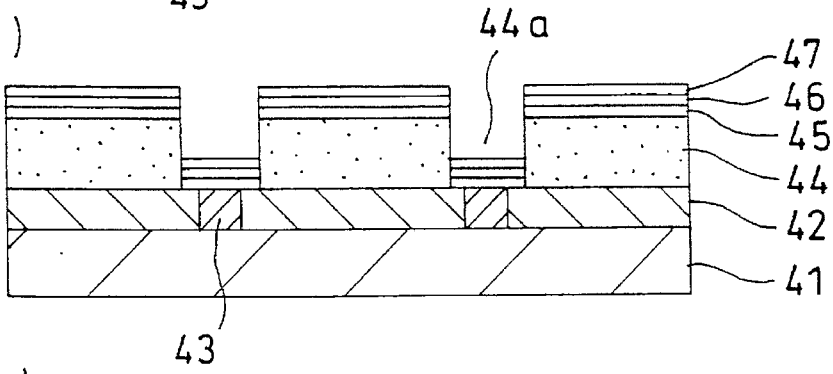
Figure 6C:
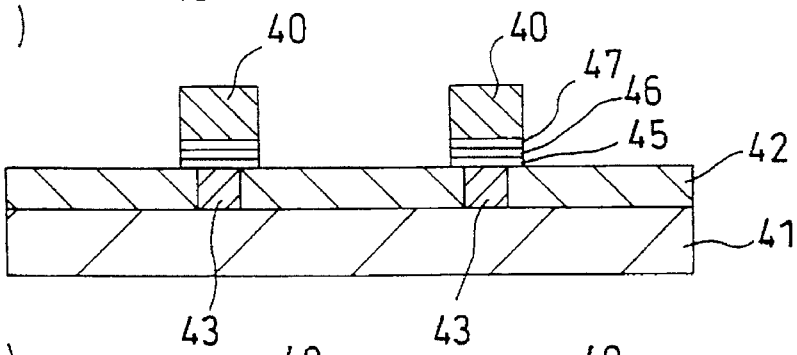
Figure 6D:
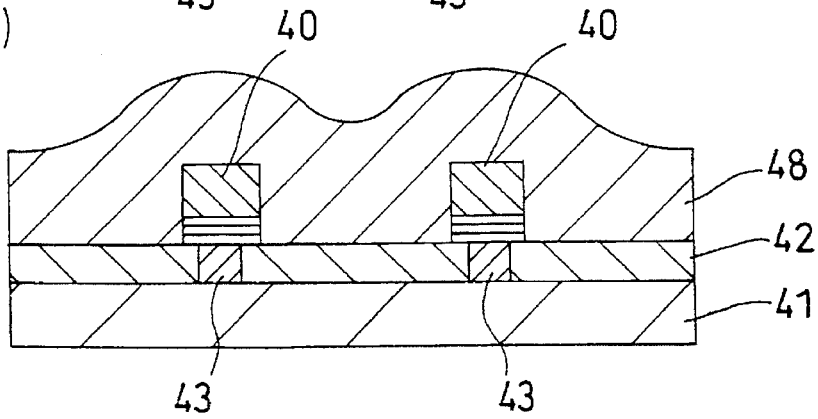
Figure 7A:
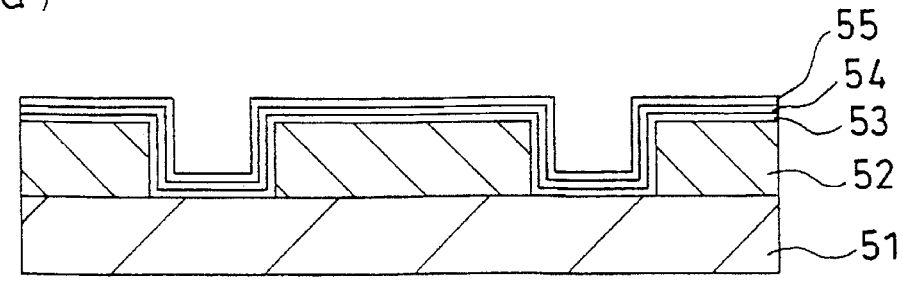
FIGS. 7(*a*), 7(*b*), 7(*c*), and 7(*d*) are section views of the steps of a fifth method of forming a wiring of a semiconductor device, using the electroless plating bath according to a third embodiment of the present invention.
Figure 7B:
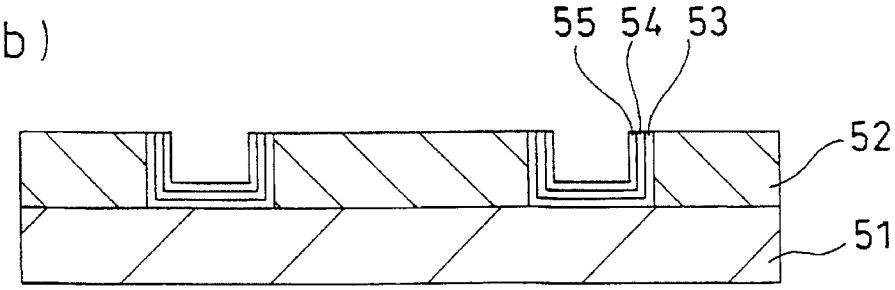
Figure 7C:
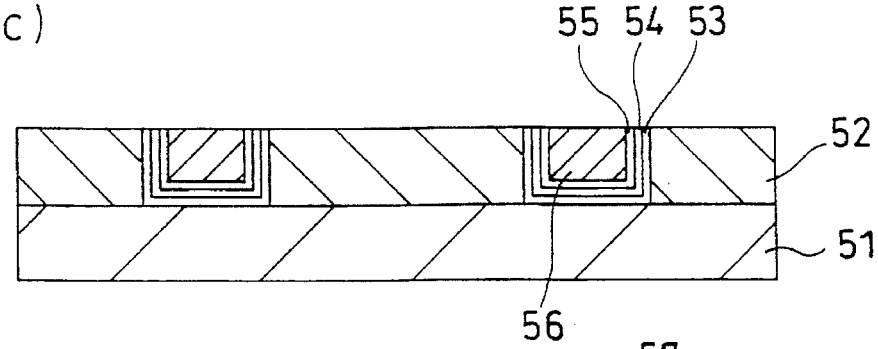
Figure 7D:
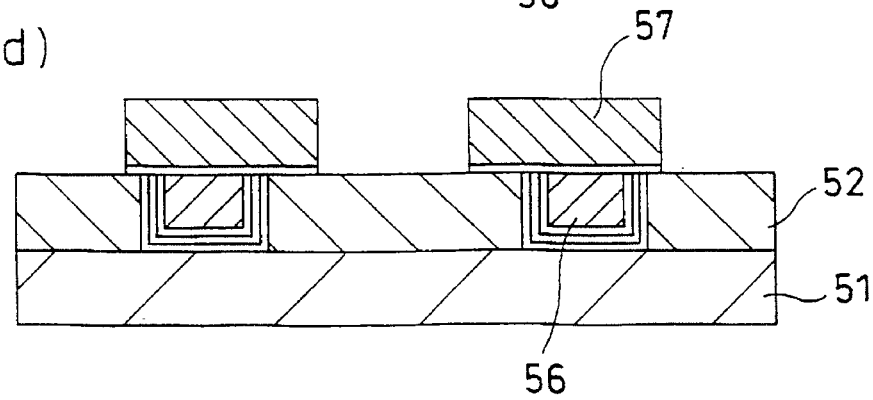

With reference to FIGS. 4(*a*), 4(*b*) and 4(*c*), the following description will discuss a second method of forming a wiring of a semiconductor device, using the plating bath according to the first embodiment.

As shown in FIG. 4(*a*), an insulating layer 22 having a thickness of 0.7 μm was deposited on a semiconductor substrate 21 having a semiconductor element (not shown) thereon. By a lithography and etching technique, there were formed a contact hole (zone which is connected to the semiconductor element) 23 and wiring grooves 24. By a sputtering method, there were deposited a Ti layer 25 (25 nm) as a resistance reducing layer for reducing the resistance between the semiconductor substrate and a silver layer, a TiN layer 26 (100 nm) as a barrier layer, and a palladium layer 27 (100 nm) as a catalyzer layer for silver plating.

As shown in FIG. 4(*b*), the palladium layer 27, the TiN layer 26 and the Ti layer 25 on the insulating layer 22 were removed by chemical mechanical polishing (CMP).

After the semiconductor substrate 21 had been immersed for 2 hours in the plating bath according to the first embodiment, the semiconductor substrate 21 was washed with water. Then, a plating bath having the same composition as above-mentioned was newly prepared, and the immersion of the semiconductor substrate 21 in the plating bath for 2 hours, was conducted again such that silver was embedded in the contact hole 23 and the wiring grooves 24 in their entirety. Thus, embedded wirings 28 made of the silver layer were formed as shown in FIG. 4(*c*). Silver plating grows only at a portion where the palladium layer 27 as the catalyzer layer is present. Accordingly, silver can selectively be embedded into the contact hole 23 and the wiring grooves 24.

Since the embedded wirings 28 contained metallic impurities such as Na, K and the like only in an amount of not greater than the allowable level, no adverse effect was exerted to the characteristics of the semiconductor element. Further, it is noted that both the plating bath of the first embodiment and the characteristics of the palladium layer 27 as the catalyzer layer, provide the embedded wirings 28 with the following three advantages. Firstly, the embedded wirings 28 are improved in finesse or compactness, the adhesion with the semiconductor substrate 21 and embedding characteristics with respect to the contact hole 23 and the wiring grooves 24. Secondly, the embedded wirings 28 are lowered in contact resistance. Thirdly, even though in order to restore damages caused by the etching conducted on the semiconductor element before the plating process, the semiconductor substrate 21 was annealed at 400° to 500° C. after the plating process, no void was formed in the embedded wirings 28 and the adhesion between the embedded wirings 28 and the semiconductor substrate 21 did not become defective.

Further, before the plating process, the palladium layer 27 may be washed with water with the surface thereof immersed in a BHF (hydrofluoric acid:ammonium fluoride= 1:20) solution such that the surface of the palladium layer 17 is cleaned.

According to the second wiring forming method, tungsten or the like may be embedded by CVD only in the contact hole 23 while embedded wirings 28 may be embedded only in the wiring grooves 24.

(Third Wiring Forming Method)

With reference to FIGS. 5(*a*), 5(*b*), 5(*c*), 5(*d*) and 5(*e*), the following description will discuss a third method of forming a wiring of a semiconductor device, using the plating bath according to the first embodiment.

As shown in FIG. 5(*a*), a first insulating layer 32 was deposited on a semiconductor substrate 31 having a semiconductor element (not shown) thereon. Contact holes were formed in the first insulating layer 32 by a lithography etching technique. A Ti layer and a TiN layer were deposited by a sputtering method, and tungsten was deposited by CVD to form tungsten plugs 33 in the contact holes. Then, there was deposited a second insulating layer 34, on which a resist pattern 35 having openings 35*a* at wiring zones was formed by a lithography technology.

With the resist pattern 35 serving as a mask, the second insulating layer 34 was subjected to etching to form wiring grooves 36 in the second insulating layer 34 as shown in FIG. 5(*b*). Then, by collimator sputtering, there were deposited a Ti layer 37 (25 nm) as a resistance reducing layer for reducing the resistance between the semiconductor element and a silver layer, a Tin layer 38 (100 nm) as a barrier layer and a palladium layer 39 (100 nm) as a catalyzer layer for silver plating.

The resist pattern 35 was removed with a cleaning solution. This caused the Ti layer 37, the Tin layer 38 and the palladium layer 39 on the resist pattern 35 to be lifted off. Thus, the Ti layer 37. the Tin layer 38 and the palladium layer 39 remained only inside of the wiring grooves 36 as shown in FIG. 5(*d*).

After the semiconductor substrate 31 had been immersed for 2 hours in the plating bath according to the first embodiment, the semiconductor substrate 31 was washed with water. Then, a plating bath having the same composition as above-mentioned was newly prepared, and the immersion of the semiconductor substrate 31 in the plating bath for 2 hours, was repeated two times such that silver was embedded in the wiring grooves 36 in their entirety. Thus, embedded wirings 40 made of the silver layer were formed as shown in FIG. 5(*e*). Silver plating grows only at a portion where the palladium layer 39 as the catalyzer layer is present. Accordingly, silver can selectively be embedded into the wiring grooves 36.

Since the embedded wirings 40 contained metallic impurities such as Na, K and the like only in an amount of not greater than the allowable level, no adverse effect was exerted to the characteristics of the semiconductor element. Further, it is noted that both the plating bath of the first embodiment and the characteristics of the palladium layer 39 as the catalyzer layer, provide the embedded wirings 40 with the following three advantages. Firstly, the embedded wirings 40 are improved in finesse or compactness, the adhesion with the semiconductor substrate 31 and embedding characteristics with respect to the wiring grooves 36. Secondly, the embedded wirings 40 are lowered in contact resistance. Thirdly, even though in order to restore damages caused by the etching conducted on the semiconductor element before the plating process, the semiconductor substrate 31 was annealed at 400° to 500° C. after the plating process, no void was formed in the embedded wirings 40 and the adhesion between the embedded wirings 40 and the semiconductor substrate 31 did not become defective.

Before the plating process, the palladium layer 39 may be washed with water with the surface thereof immersed in a BHF (hydrofluoric acid:ammonium fluoride=1:20) solution such that the surface of the palladium layer 39 is cleaned.

(Fourth Wiring Forming Method)

With reference to FIGS. 6(*a*), 6(*b*), 6(*c*) and 6(*d*), the following description will discuss a fourth method of forming a wiring of a semiconductor device, using the plating bath according to the first embodiment.

As shown in FIG. 6(*a*), a first insulating layer 42 was deposited on a semiconductor substrate 41 having a semiconductor element (not shown) thereon. Contact holes were formed in the first insulating layer 42 by a lithography etching technique. A Ti layer and a TiN layer were deposited by a sputtering method, and tungsten was deposited by CVD to form tungsten plugs 43 in the contact holes. Then, a resist pattern 44 having openings 44*a* at wiring zones was formed on the first insulating layer 42 by a lithography technology.

By collimator sputtering, there were deposited a Ti layer 45 (25 nm) as a resistance reducing layer for reducing the resistance between the semiconductor element and a silver layer to be formed later, a Tin layer 46 (100 nm) as a barrier layer and a palladium layer 47 (100 nm) as a catalyzer layer for silver plating, as shown in FIG. 6(*b*).

The palladium layer 47, the Tin layer 46 and the Ti layer 45 on the resist pattern 44 were removed by chemical and mechanical polishing (CMP). After the semiconductor substrate 41 had been immersed for 2 hours in the plating bath according to the first embodiment, the semiconductor substrate 41 was washed with water. Then, a plating bath having the same composition as above-mentioned was newly prepared, and the immersion of the semiconductor substrate 41 in the plating bath for 2 hours, was repeated two times such that metallic wirings 40 were selectively formed in the openings 44*a* in the resist pattern 44 (See FIG. 6(*c*)). Silver plating grows only at a portion where the palladium layer 47 as the catalyzer layer is present. Accordingly, the metallic wirings 40 can selectively be formed only in the wiring zones.

Then, the resist pattern 44 was removed by a cleaning solution such that the metallic wirings 40 remained as shown in FIG. 6(*c*). Then, a second insulating layer 48 as an interlaminar insulating layer was entirely deposited as shown in FIG. 6(*d*).

It is noted that, according to each of the first to fourth wiring forming methods above-mentioned, a wiring can successfully be formed with the use of an electroless plating bath according to a second embodiment of the present invention to be discussed in the following.

(Second Embodiment)

The following description will discuss an electroless plating bath according to the second embodiment of the present invention.

*Electroless Copper Plating Bath According to the Second Embodiment of the Present Invention

| | |
|---|---|
| Cupric sulfate (copper ion source) | $6.0 \times 10^{-2}$ mol/l |
| Formaldehyde (reducing agent) | $4.0 \times 10^{-1}$ mol/l |
| Ethylenediaminetetraacetic acid (complexing agent) | $3.0 \times 10^{-1}$ mol/l |
| 15-wt % Solution of tetramethylammonium-hydroxide (pH control agent) | |
| 8-Hydroxy-7-iode-5-quinoline sulfonic acid (stabilizer) | $2.0 \times 10^{-4}$ mol/l |
| pH | 12.8 |
| Bath temperature | 75° C. |
| Copper deposition speed | 3 μm/hour |

(Third Embodiment)

The following description will discuss the electroless plating bath according to a third embodiment of the present invention.

There was prepared an electroless nickel plating bath having the following composition. The amounts of Na and K in this electroless plating bath as measured by atomic emission spectroscopy (ICP), were as small as 4 ppm and 3 ppm, respectively. It is considered that such impurities in small amounts were mixed in production steps of the respective components.

*Electroless Nickel Plating Bath According to the Third Embodiment of the Present Invention:

| | |
|---|---|
| Nickel sulfate (nickel ion source) | $8.0 \times 10^{-2}$ mol/l |
| Hypophosphorous acid (reducing agent) | $2.3 \times 10^{-1}$ mol/l |
| Lactic acid (complexing agent) | $3.0 \times 10^{-1}$ mol/l |
| Propionic acid (pH buffer) | $3.0 \times 10^{-2}$ mol/l |
| 15-wt % Solution of tetramethylammonium-hydroxide (pH control agent) | |
| Thiourea (stabilizer) | $5.0 \times 10^{-6}$ mol/l |
| pH | 4.5 |
| Bath temperature | 90° C. |

Using the plating bath of the third embodiment, a nickel plated layer having a thickness of 0.3 μm was deposited on the semiconductor substrate. The amounts of Na and K in this nickel plated layer were measured as 0.2 ppm and 0.2 ppm, respectively. These values are much lower than the allowable level for metallic impurities contained in a wiring metal of a semiconductor device. Thus, it was made sure that the nickel layer deposited with the use of this plating bath can be used for a metallic wiring of a semiconductor device.

(Fifth Wiring Forming Method)

With reference to FIGS. 7(*a*), 7(*b*), 7(*c*) and 7(*d*), the following description will discuss a fifth method of forming a wiring of a semiconductor device, using the plating bath according to the third embodiment.

As shown in FIG. 7(*a*), an insulating layer 52 was deposited on a semiconductor substrate 51 having a semiconductor element (not shown) thereon. By a lithography and etching technique, there were formed contact holes in the insulating layer 52. By a sputtering method, there were deposited a Ti layer 53 (25 nm) as a resistance reducing layer for reducing the resistance between the semiconductor substrate and a nickel layer to be formed later, a TiN layer 54 (100 nm) as a barrier layer, and a palladium layer 55 (100 nm) as a catalyzer layer for nickel plating.

Then, as shown in FIG. 7(*b*), the palladium layer 55, the Tin layer 54 and the Ti layer 53 on the insulating layer 52 were removed by chemical mechanical polishing (CMP).

After the semiconductor substrate 51 had been immersed for 1 hours in the plating bath according to the third embodiment, the semiconductor substrate 51 was washed with water. Thus, nickel was entirely embedded in the contract holes to form embedded plugs 56 made of a nickel layer as shown in FIG. 7(*c*). Nickel plating grows only at a portion where the palladium layer 55 as the catalyzer layer is present. Accordingly. nickel can selectively be embedded in the contact holes.

Then, there were successively deposited a Ti layer as a resistance reducing layer, a first metallic layer of a Tin layer as a barrier layer and a second metallic layer as an aluminium wiring layer. These first and second metallic layers were subjected to lithography and etching to form metallic wiring 57 of aluminium on the embedded plugs 56.

Since the embedded plugs 56 contained metallic impurities such as Na, K and the like only in an amount of not greater than the allowable level, no adverse effect was exerted to the characteristics of the semiconductor element. Further, it is noted that both the plating bath of the third embodiment and the characteristics of the palladium layer 55 as the catalyzer layer, provide the embedded plugs 56 with the following three advantages. Firstly, the embedded plugs 56 are improved in finesse or compactness, the adhesion with the semiconductor substrate 51 and embedding characteristics with respect to the contact holes. Secondly, the embedded plugs 56 are lowered in contact resistance. Thirdly, even though in order to restore damages caused by the etching conducted on the semiconductor element before the plating process, the semiconductor substrate 51 was annealed at 400° to 500° C. after the plating process, no void was formed in the embedded plugs 56 and the adhesion between the embedded plugs 56 and the semiconductor substrate 51 did not become defective.

Before the plating process, the palladium layer 55 may be washed with water with the surface thereof immersed in a BHF (hydrofluoric acid:ammonium fluoride=1:20) solution such that the surface of the palladium layer 55 is cleaned.

The concentrations of the components, the pH, the temperature and the like of the plating bath according to the third embodiment, are not limited to those mentioned earlier, but may be set such that nickel does not separate out in the plating bath, and that the plating bath is stable from the start of plating to the completion of deposition of a nickel layer on the semiconductor substrate. After hard study of the inventors of the present invention, it was found that, with respect to the molarity of nickel nitrate, the molarity of hypophosphorous acid and lactic acid was preferably about 2 times to about 10 times and the molarity of thiourea was preferably 1/50000 to 1/10000, that the pH was preferably from about 3.5 to about 6, and that the temperature was preferably from about 80° C. to about 100° C. According to the present invention, however, such conditions are not limited to those above-mentioned.

Further, the plating bath according to the first or second embodiment was used in each of the first to fourth wiring forming methods, and the plating bath according to the third embodiment was used in the fifth wiring forming method. However, the present invention is not limited to such applications.

In each of the first to fifth wiring forming methods, the embedded wirings or embedded plugs are different in material from the layer thereunder. Accordingly, the resistance reducing layer, the barrier layer and the catalyzer layer are formed. However, when. the embedded wirings or embedded plugs are the same in material as the layer thereunder, such resistance reducing layer, barrier layer and catalyzer layer may not be formed.

We claim:

1. An electroless plating bath to be used for forming a wiring of a semiconductor device, comprising:

a metallic material containing metallic ions;

a reducing agent of said metallic ions which contains no metal in the chemical formula thereof;

a complexing agent of said metallic ions which contains no metal in the chemical formula thereof; and a pH control agent which contains no metal in the chemical formula thereof, wherein said metallic ions are silver ions, copper ions, gold ions or palladium ions, and said reducing agent comprises at least one substance selected from the group consisting of tartaric acid, tartrate containing no metal in the chemical formula thereof, monosaccharide, disaccharide, polysaccharide and polyol.

2. An electroless plating bath to be used for forming a wiring of a semiconductor device, comprising:

a metallic material containing metallic ions which is composed of silver nitrate;

a reducing agent of said metallic ions which is composed of tartaric acid;

a complexing agent of said metallic ions which is composed of ethylenediamine; and a pH control agent which is composed of tetramethylammoniumhydroxide.

* * * * *